United States Patent [19]

Oswald

[11] 4,020,321

[45] Apr. 26, 1977

[54] ELECTRIC HEATERS

[75] Inventor: Roger Derek Oswald, Crawley, England

[73] Assignee: BOC Limited, Crawley, England

[22] Filed: Mar. 11, 1975

[21] Appl. No.: 557,368

[30] Foreign Application Priority Data

Mar. 14, 1974 United Kingdom ..... 11479/74

[52] U.S. Cl. ..... 219/271; 219/275; 219/307; 219/374; 219/381; 239/136

[51] Int. Cl.[2] ..... H05B 3/02; F24H 1/10; F28B 1/28

[58] Field of Search ..... 219/271–276, 219/374–376, 381, 382, 307; 239/135, 136

[56] References Cited

UNITED STATES PATENTS

| | | | |
|---|---|---|---|
| 3,686,474 | 8/1972 | Power | 219/275 X |
| 3,688,083 | 8/1972 | Rice et al. | 219/275 X |
| 3,691,346 | 9/1972 | Dyre et al. | 219/374 |
| 3,781,518 | 12/1973 | Power et al. | 219/275 X |
| 3,869,242 | 3/1975 | Schladitz | 219/381 X |

*Primary Examiner*—A. Bartis
*Attorney, Agent, or Firm*—Dennison, Dennison, Meserole & Pollack

[57] ABSTRACT

An element for an electrically-energized vaporizer for liquid, including a body of electro-conductive material that has one major face defining a liquid inlet and a second major face defining a vapor outlet. The body is both thermally and chemically stable and is permeable by a liquid to be vaporized. The body is electrically energizable to heat and vaporize liquid as it flows from the liquid inlet face to the vapor outlet face. A plurality of blind recesses in the body are open to the vapor outlet face for providing effective escape routes for earliest produced vapor in the body whereby the entrainment of liquid in vapor issuing from the vapor outlet face is reduced.

15 Claims, 6 Drawing Figures

FIG. 3
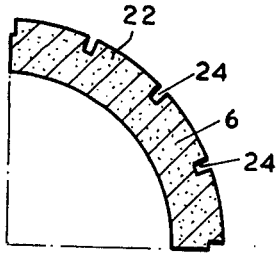
FIG. 4
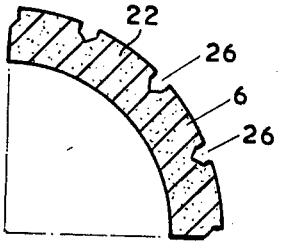
FIG. 5
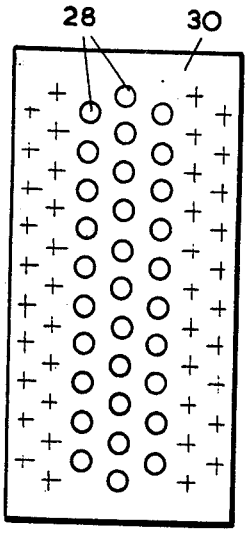
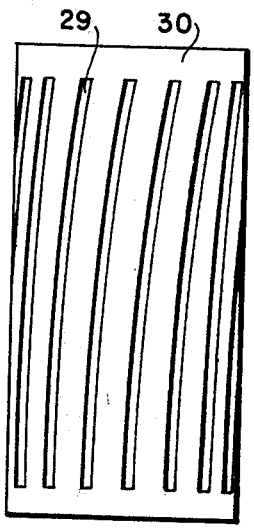
FIG. 6

ELECTRIC HEATERS

This invention relates to permeable electric heaters for liquids, and in particular to apparatus in which liquids are heated electrically until a significant portion thereof is vaporised. One preferred use of an electric heater of the present invention is to vaporise phlegmatic oils for use in vapour vacuum pumps.

The present invention aims at providing an element for such an heater, which element emits vapour readily but with reduced entrainment of unvaporised liquid.

Accordingly the present invention provides an element for an electrically energised vaporiser of liquids which is as claimed in the appended claims.

The present invention will now be described by way of example with reference to the accompanying drawing, in which:

FIG. 5 is a side view of a form of element using blind holes instead of grooves.

FIG. 6 is a side view of a form of element using elongated recesses or grooves inclined at an angle relative to the longitudinal axis of the element.

Figure 1:
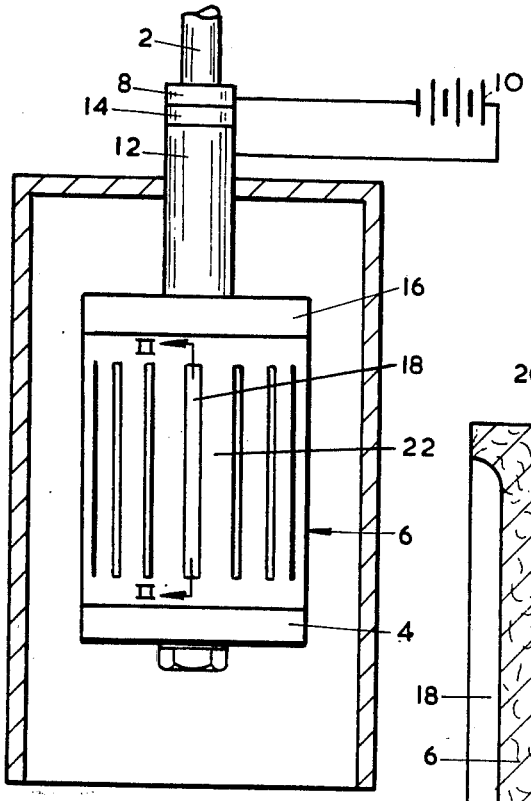
FIG. 1 is a diagrammatic view, part in section and part in elevation, of an element of the present invention in position in a vaporiser.

Apart from the grooves, the element is of the sort intended to be used in a vaporiser in the type described in British application No. 30147/71 now British specification No. 1,395,494, and corresponding U.S. application Ser. No. 267,413, filed June 29, 1972, now U.S. Pat. No. 3,781,518, issued Dec. 25, 1973. Although the vaporiser of the present invention is particularly applicable for use with vapour vacuum pump oils, it can in principle be used with many other liquids, including water.

In such vaporisers the liquid to be vaporised is introduced into the vaporiser through a tube 2 which is connected at its lower end (as viewed) to a terminal 4 defining an annular contact face against which is pressed the lower end face of the cylindrical heater element 6. The tube 2 is perforated internally of the element 6 so as to enable the liquid to be vaporised to fill the internal space of element 6 and flow radially outwardly through the element.

Secured to the tube 2 is a collar 8 which also functions as one terminal of a source 10, usually low voltage, high-amperage, of heating current. Collar 8 is insulated from a lower (as viewed) tubular support 12 by means of an insulating section 14, which is illustrated only diagrammatically. The support 12 carries at its lower end an upper terminal 16 for the element, the terminal 16, similar to terminal 4, defining an annular contact face for the upper end face of element 6.

The insulating section 14 is designed so as to be axially compressible so that it biases terminals 4 and 16 axially towards each other by placing the lower part of tube 2 in tension.

The tubular support 12 is connected to the other side of the source 10 of heating current, so that, in operation, a potential difference is established between terminals 4 and 16.

The element 6 has an electrical resistivity which is chosen so that it releases Joule heat at a desired rate to the liquid as the liquid flows radially through the element. The rate of supply of heat, and the rate of flow of the liquid, are related to each other so that the liquid is substantially completely vaporised in passing through the element, although, for safety reasons, it is usually preferred to ensure that there is a slight 'drip' of unvaporised liquid from the element when conditions are stabilised, because it is important that the element does not run any risk of becoming dry, as this may lead to the formation of hot spots. These in turn can lead to the pyrolytic decomposition of the liquid and this in turn can result in catastrophic breakdown of the element.

In those forms of the invention using a cylindrical element, the flow of the liquid to be vaporised is radially outwards from the centre of the element, although it is within the bounds of possibility for the flow to be radially inwards. This latter possibility is not preferred because of the rapid increase in volume of the liquid as it is vaporised, but it could be advantageous in some applications for the vapour to issue from the hollow cylindrical space in the interior of the element.

In accordance with the present invention, the exit face (which is usually the outer face, for reasons just discussed) is provided with a plurality of recesses. In cylindrical elements the recesses preferably take the form of parallel grooves or slots 18. Normally the grooves 18 terminate short of the ends of the element 6 so as to leave uninterrupted annular contact faces 20, but there could be cases in which continuing the grooves throughout the length of the element would result in a cheaper construction of which the performance is not appreciably reduced.

The element 6 is made from a material consisting primarily of carbon fibres, so that the element presents a known electrical resistance to the potential difference established between terminals 4 and 16. Although carbon fibres are preferred for the element, other materials could be used. The interstitial spaces between the fibres act as flow passages through which the liquid to be vaporised can permeate, thus presenting a known impedance to the fluid flow. In most instances the fluid flow impedance presented by the element is smaller than that necessary to ensure uniform flow distribution. In such cases, it is usual to line the entry face of element 6 with a permeable member 7 adding the desired necessary extra flow impedance, without presenting a bypass to the flow of heating current. The use of this permeable member (or liner) 7 can also affect favourably the way in which heat is transferred to the fluid. The liner is made of an inert material, such as alumina, which is an insulant and which can be produced in fibrous form. The addition of this extra flow impedance is already known and does not form part of the subject-matter of this invention and so will not be described herein in any further detail.

As has already been mentioned, when the liquid is vaporised, it changes its volume quite dramatically upon vaporisation. This results in the liquid entering the entry face of element 6 at a relatively low speed but leaving as vapour from the exit face at a much higher speed. This speed of emission of the vapour can be so high that it entrains liquid with it, so that the vaporiser emits a spray of liquid droplets as well as the vapour. The removal of liquid from the element in this manner can upset the local and overall balance between heat input and the amount of liquid heated and vaporised, and this can lead to local or general overheating of the element. The presence of this spray is therefore objectionable, and the present invention aims at reducing the production of this spray so that it becomes virtually negligible. This is achieved by providing the grooves 18.

In considering the manner in which the grooves act to mitigate the formation of spray, it must be remembered that part of the liquid flow begins to turn into vapour deep inside the thickness of the element. During the remainder of the flow path to the outside surface of the element more and more liquid is progressively converted to vapour. The enormous increase in fluid volume as liquid is converted to vapour is accompanied by a correspondingly increased flow velocity. This can entrain and accelerate not-yet-evaporated liquid and disturb the uniform pattern of liquid flow so that liquid drops are carried out with the vapour before they have a chance to turn into vapour themselves.

The presence of the grooves provides alternative paths for the escape from the element of vapour formed deep inside the overall thickness be of the element early in the passage of liquid through the element. Such vapour can now escape sideways into the grooves without any need to displace before it liquid flowing in a radial direction and lying between it and the normal external surface of the element. Not only will the velocity of vapour within the element structure be reduced by the extra directions made available for vapour flow, but also any tendency for the vapour emerging from the walls of the grooves to entrain a spray of liquid is relatively unimportant, since such liquid droplets have a good chance of colliding with another part of the groove wall and re-entering the element through surface tension forces.

To summarise, the grooves act to provide venting for the free escape of vapour formed deep below the normal exit surface of the element without the need for the vapour to displace liquid before it. They act to provide extra directions for vapour flow so that the velocity of vapour flow within the porous structure is reduced. They act to provide a degree of trapping for any spray thrown out within the grooves themselves, the spray droplets being too massive to be easily affected by the vapour flow out of the grooves and therefore having a good chance of impinging on a groove surface and reentering the element.

As can be seen from FIGS. 3 and 4, the cross-sectional shapes of the grooves 18 can vary quite appreciably, ranging from the narrow grooves 24 of FIG. 3 (which might be regarded by some people as being more properly termed slots) to the relatively-broad grooves 26 of the FIG. 4 construction. The angular spacings and the cross-sectional shape and area of these grooves can be chosen by experiment to be the optimum for the particular liquid to be vaporised.

In the case of vapour vacuum pump fluids it has been found that a satisfactory depth for the grooves is about one-third of the radial thickness. If water is being vaporised it is expected that a significantly-greater depth could prove advantageous. From the explanation given above it is clear that the grooves should penetrate to a depth where a significant amount of vapour generation begins, so that they can provide effective escape routes for the earliest-produced vapour. The actual depth of the groove should be related to the specific and latent heats of the liquid to be evaporated. The liquid has to travel a certain distance in acquiring sufficient heat to be raised to its boiling point. Thereafter the liquid absorbs further heat in order to be vaporised. The groove depth has therefore to be related to the depth at which the liquid first reaches its boiling point. In the case of water the relationship between specific and latent heats results in vaporisation commencing earlier during the passage of the water through the element than is found in the case of vapour vacuum pump fluids. Grooves for a steam generator should therefore be about 9/10 of the radial thickness of the vaporizer.

With regard to the spacing of the grooves, this must clearly affect the thickness of the ribs 22. From the explanation given above it is clear that the ribs should be sufficiently thin for vapour generated within them at their roots to find the flow paths sideways into the grooves which provide a flow impedance comparable with, or lower than, that of the vapour flow path radially outwards through the rib to the normal exit face. The width of the rib is, therfore, normally made comparable with the depth of the adjacent grooves, and is unlikely to exceed twice that depth. Optimum dimensions have yet to be determined for different liquids and conditions.

In most forms of the grooved element, the grooves will be running parallel both to each other and to the longitudinal axis of the element. However, in some cases it might be desirable to incline the grooves at a slight angle to the longitudinal axis of the element, or to impart a slight helical twist to the grooves 18, and therefore to the ribs 22.

As far as the electric heating current is concerned, the grooved element 6 presents an electrical path in the form of a plain hollow cylinder having a series of conductive ribs on its external surface. When the ribs extend in parallel with the axis of the element, the current finds itself faced with paths of equal length, and so the ribs tend to have the same current density as the basic cylinder of the element. However, when the ribs are helical they present paths of greater electrical length than the cylinder, so that the current density in the ribs tends to become lower than that in the cylinder. This can be used to bring about a desired electrical decoupling of the ribs from the cylinder, by imparting a helical twist to the ribs.

This can be advantageous in instances where it is desirable to sustain a high power density in that part of the element where the liquid enters (so as rapidly to heat up the initially-cool liquid) and to sustain a lower power density in that part of the element where most of the liquid has already turned into vapour (to reduce the risk of formation of hot spots, which can easily occur near the outside surface of the element if too high a power density arises in the absence of liquid flow and the associated rapid heat transfer).

Another advantage of providing the grooves 18 is that they prevent the propagation of hot spots between adjacent ribs. In plain, cylindrical elements it has been found that, when a hot spot develops, it tends to grow substantially uniformly at the exit face of the element. This growth is brought about by the accretion of solid decomposition products. As these accretions reduce the fluid flow in the region of the hot spot, the temperature of the hot spot will rise, reducing the electrical resistance of the hot spot and its immediate surroundings. The heating current is then diverted through the hot spot from the adjacent areas, thus resulting in the release of additional heat at the hot spot and the further decomposition of the liquid. However, the grooves 18 effectively reduce the rate of growth of hot spots (and associated patches of decomposition residues of the liquid) by providing surface discontinuities in the circumferential direction. Any hot spot which forms can grow only axially along the particular rib in which it forms, leaving the rest of the element unaffected by the presence or growth of the hot spot.

Figure 2:
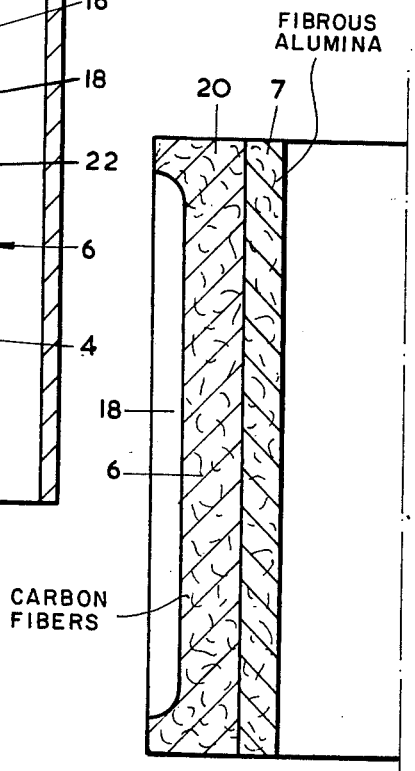
FIG. 2 is a diagrammatic cross-section through the heater element, along the line II—II of FIG. 1, FIGS. 3 and 4 are transverse cross-sectional views of two heater elements having different forms of groover or holes in the outer surface.

FIGS. 1 to 4 show that form of the invention in which the vapour-venting recesses take the form of longitudinal grooves. In FIG. 5 is shown an alternative form in which the recesses are in the form of an array of blind holes 28 in the cylindrical exit face 30. In FIG. 6 is shown an alternative form in which the recesses are in the form of an array of elongated grooves 29 running generally parallel to each other and inclined relative to the longitudinal axis of the element 6 and in fact having a slight helical twist. The holes 28 can have parallel or sloping sides as will be appreciated from a consideration of the recesses 24 and 26 of FIGS. 3 and 4. The area of each hole, and the way in which the holes are distributed over face 30, are chosen to achieve the desired balance between the vapour venting provided by the holes and the heating provided by the electricity flowing through the material between and adjacent to the holes.

I claim:

1. An element for an electrically energized vaporizer for liquid, including a body of electro-conductive material having one major face defining a liquid inlet and a second major face defining a vapor outlet which body is both thermally and chemically stable and is permeable by a liquid to be vaporized, said body being electrically energizable to heat and vaporize liquid as it flows from said liquid inlet face to said vapor outlet face, and means in the form of a plurality of blind recesses in said body open to said vapor outlet face for providing effective escape routes for earliest produced vapor in said body whereby the entrainment of liquid in vapor issuing from said vapor outlet face is reduced compared with the amount of entrainment of liquid which would result if the escape route means were not present.

2. An element for an electrically energized vaporizer of liquid, including a body of electro-conductive material having one major face defining a liquid inlet and a second major face defining a vapor outlet which body is both thermally and chemically stable and is permeable by a liquid to be vaporized, said body being electrically energizable to heat and vaporize liquid as it flows from said liquid inlet face to said vapor outlet face said body being in the form of a hollow cylinder wherein said vapor outlet face is a cylindrical surface, blind recess means in the form of a plurality of parallel elongated recesses comprising grooves or slots in said body open to said vapor outlet face, and extending substantially between the ends of the cylinder for providing effective escape routes for earliest produced vapor whereby the entrainment of liquid in vapor emerging from said second major face is reduced compared with the amount of entrainment of liquid which would result if the escape route means were not present.

3. An element as claimed in claim 2, in which said vapor outlet face is the outer surface of the cylinder and in which said recesses terminate short of the ends thereof, the said grooves or slots being parallel to each other.

4. An element as claimed in claim 2 in which the depth of the recesses is related to the ratio of the specific and latent heats of the liquid.

5. An element as claimed in claim 4, in which the depth of the recesses is less than half the radial thickness of the body of the cylinder, for a vapor vacuum pump oil.

6. An element as claimed in claim 5, in which the depth of the recesses is about one-third the radial thickness of the body of the cylinder.

7. An element as claimed in claim 6, in which the said rib thickness is not more than twice the depth of the said adjacent recesses.

8. An element as claimed in claim 7, in which the rib thickness is substantially the same as the depth of the adjacent recesses.

9. An element as claimed in claim 4, in which the depth of the recesses is about nine-tenths of the radial thickness of the body of the cylinder, for water.

10. An element as claimed in claim 2, in which the transverse thickness of the ribs on said second major face defined between adjacent recesses is related to the depth of the said adjacent recesses.

11. An element as claimed in claim 2, in which said vapor outlet face is the outer surface of the cylinder and said grooves or slots terminate short of the ends thereof, the said grooves or slots being inclined at a slight angle to the longitudinal axis of the cylinder.

12. An element for an electrically energized vaporizer of liquid, including a body of electro-conductive material having one major face defining a liquid inlet and a second major face defining a vapor outlet which body is both thermally and chemically stable and is permeable by a liquid to be vaporized, said body being electrically energizable to heat and vaporize liquid as it flows from said liquid inlet face to said vapor outlet face said body being in the form of a hollow cylinder having said vapor outlet face as the outer cylindrical surface, blind recess means in the form of blind holes of which the cross-sectional area and the distribution are predetermined for providing effective escape routes for earliest produced vapor whereby the entrainment of liquid in vapor emerging from said second major face is reduced compared with the amount of entrainment of liquid which would result if the escape route means were not present.

13. An element as claimed in claim 12, in which the blind holes have parallel sides.

14. An element as claimed in claim 12, in which the depth of the blind holes is about one-third of the radial thickness of the body of the cylinder, for vapor vacuum pump oils.

15. An element as claimed in claim 12, in which the depth of the blind holes is about nine-tenths the radial thickness of the body of the cylinder, for water.

* * * * *